US008251474B2

(12) United States Patent
Sugahara

(10) Patent No.: US 8,251,474 B2
(45) **Date of Patent: *Aug. 28, 2012**

(54) DROPLET EJECTOR

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 339 days.

This patent is subject to a terminal disclaimer.

(21) Appl. No.: 12/626,125

(22) Filed: Nov. 25, 2009

(65) Prior Publication Data

US 2010/0128077 A1 May 27, 2010

(30) Foreign Application Priority Data

Nov. 25, 2008 (JP) ..... 2008-298954

(51) Int. Cl.
*B41J 29/38* (2006.01)

(52) U.S. Cl. ..... 347/14; 347/19

(58) Field of Classification Search ..... 347/14, 347/19

See application file for complete search history.

(56) References Cited

U.S. PATENT DOCUMENTS

| | | | | |
|---|---|---|---|---|
| 5,835,110 | A | 11/1998 | Sasaki | |
| 6,857,722 | B1 | 2/2005 | Greiser et al. | |
| 7,077,501 | B2 | 7/2006 | Kitahara et al. | |
| 7,090,419 | B2 | 8/2006 | Satoh et al. | |
| 2004/0160475 | A1 * | 8/2004 | Satoh et al. | 347/36 |
| 2004/0179062 | A1 | 9/2004 | Rai et al. | |
| 2008/0030563 | A1 * | 2/2008 | Yoshida | 347/104 |
| 2009/0244240 | A1 * | 10/2009 | Sugahara | 347/104 |
| 2010/0128089 | A1 | 5/2010 | Sugahara | |

FOREIGN PATENT DOCUMENTS

| | | | |
|---|---|---|---|
| JP | 2003-072041 | A | 3/2003 |
| JP | 2004-276374 | A | 10/2004 |
| JP | 2004-306578 | A | 11/2004 |
| JP | 2008-036906 | A | 2/2008 |
| JP | 2009-262544 | A | 11/2009 |

OTHER PUBLICATIONS

Japan Patent Office, Notice of Reasons for Rejection for Japanese Patent Application No. 2008-298954 (counterpart to above-captioned patent application), mailed Oct. 12, 2010.

United States Patent and Trademark Office, Notice of Allowance and Fees Due for U.S. Appl. No. 12/626,427 (counterpart to above-captioned patent application), mailed Dec. 27, 2011.

* cited by examiner

*Primary Examiner* — Laura Martin
(74) *Attorney, Agent, or Firm* — Baker Botts L.L.P.

(57) ABSTRACT

A droplet ejector includes: at least one head unit each having a droplet ejection surface; a conveyor mechanism which conveys, an ejection target in a conveyance direction in parallel to the ejection surface, the ejection target being an object on which a droplet from the at least one head unit impacts; at least one pushing component which is arranged to be movable with respect to the at least one head unit in a direction orthogonal to the ejection surface, the at least one pushing component pushing the ejection target in a direction of droplet ejection from the nozzles while protruding from the ejection surface; a pushing drive mechanism which moves the at least one pushing component in the direction orthogonal to the ejection surface; and a control unit.

10 Claims, 12 Drawing Sheets

DROPLET EJECTOR

CROSS REFERENCE TO RELATED APPLICATION

The present application claims priority from Japanese Patent Application No. 2008-298954, which was filed on Nov. 25, 2008, the disclosure of which is herein incorporated by reference in its entirety.

BACKGROUND OF THE INVENTION

1. Field of the Invention

The present invention relates to a droplet ejector which ejects a droplet from a nozzle formed in a head unit.

2. Description of Related Art

An inkjet recording apparatus is a conventional droplet ejector which ejects droplets from nozzles of a head unit onto an ejection target which is fed by a conveyance apparatus. In such an inkjet recording apparatus, when ink droplets ejected from the nozzles impact onto a sheet which is an ejection target and permeate therein, the area of the sheet in which area the ink has permeated contracts in plane, and hence an edge near the area where the ink has permeated is warped toward the record head. If the warped sheet touches the surface (droplet ejection surface) of the record head on which surface the nozzles are formed and scratches the surface, the droplet ejection properties may be changed because for example the direction of droplet ejection from the nozzles is changed.

A way of preventing the sheet from being warped is to push the sheet. For example, an inkjet recording apparatus which prevents a sheet from being warped is arranged such that plural record heads are disposed along the conveyance direction of the sheets and a star wheel which is a pushing component pushing a sheet toward the conveyance apparatus is provided between neighboring record heads.

This inkjet recording apparatus, however, is disadvantageous in that, because the pushing component is provided in the vicinity of the head unit and is biased from above so as to always protrude toward the conveyance apparatus from the ejection surface of the head unit, the pushing component gets in the way when, for example, a maintenance operation such as the wiping of the ejection surface of the head unit is carried out or a sheet jammed between the head unit and the conveyance apparatus is removed.

SUMMARY OF THE INVENTION

An object of the present invention is to provide a droplet ejector in which the positional relationship between the pushing component and the ejection surface is freely changeable.

A droplet ejector of the present invention includes: at least one head unit each having a droplet ejection surface on which plural nozzles are provided; a conveyor mechanism which conveys, at a position opposing the ejection surface, an ejection target in a conveyance direction in parallel to the ejection surface, the ejection target being an object on which a droplet from the at least one head unit impacts; at least one pushing component which is arranged to be movable with respect to the at least one head unit in a direction orthogonal to the ejection surface, the at least one pushing component pushing the ejection target in a direction of droplet ejection from the nozzles while protruding from the ejection surface; a pushing drive mechanism which moves the at least one pushing component in the direction orthogonal to the ejection surface, between a protruding position in which the at least one pushing component protrudes from the ejection surface of the at least one head unit and a retracted position in which the at least one pushing component does not protrude from the ejection surface; and a control unit for controlling the at least one head unit, the conveyor mechanism, and the pushing drive mechanism.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Now, an inkjet printer of a preferred embodiment of the present invention will be discussed. The inkjet printer of the present embodiment adopts a line-type inkjet head in which plural head units and plural spurs are alternately provided in the main scanning direction.

Figure 1:
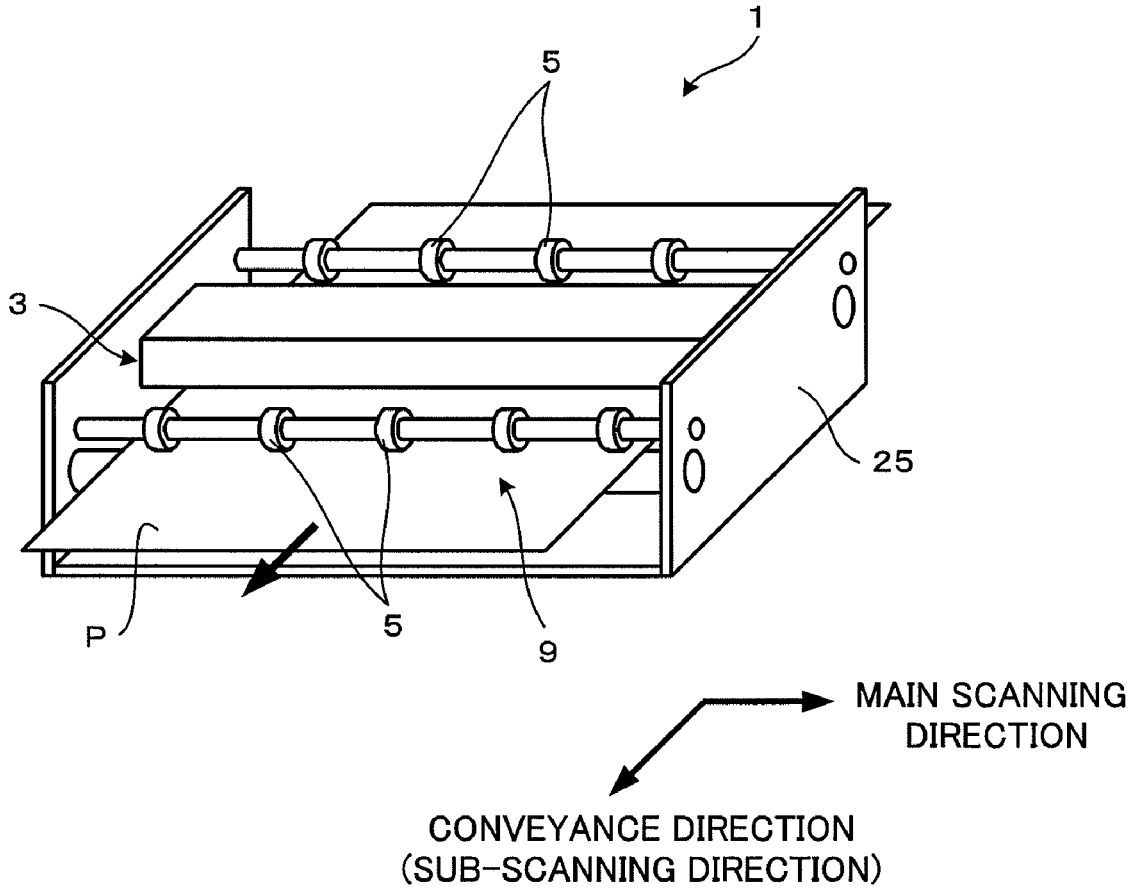
FIG. 1 is a schematic diagram of an inkjet printer of an embodiment of the present invention.

As illustrated in FIG. 1, the inkjet printer 1 (droplet ejector) includes: a line-type inkjet head 3 which extends in the horizontal direction of FIG. 1 (i.e. main scanning direction) and ejects ink onto a record sheet P (ejection target); a conveyor mechanism 9 which transports a record sheet P towards the viewer of FIG. 1 (i.e. in the conveyance direction (sub-scanning direction) orthogonal to the main scanning direction); and a control unit 100 which entirely controls the inkjet printer 1. This inkjet printer 1 feeds a record sheet P toward the viewer of FIG. 1 by the conveyor mechanism 9 at the same time causes the inkjet head 3 to eject ink onto the record sheet P, so as to print a desired image, text, or the like on the record sheet P.

The conveyor mechanism 9 has two conveyor rollers 5 provided on the both sides of the inkjet head 3 in the conveyance direction. At the position opposing a later-mentioned ink ejection surface 7 of the head unit 2, the conveyor mechanism 9 conveys, by the conveyor rollers 5, a record sheet P in the conveyance direction in parallel to the ink ejection surface 7.

Figure 2:
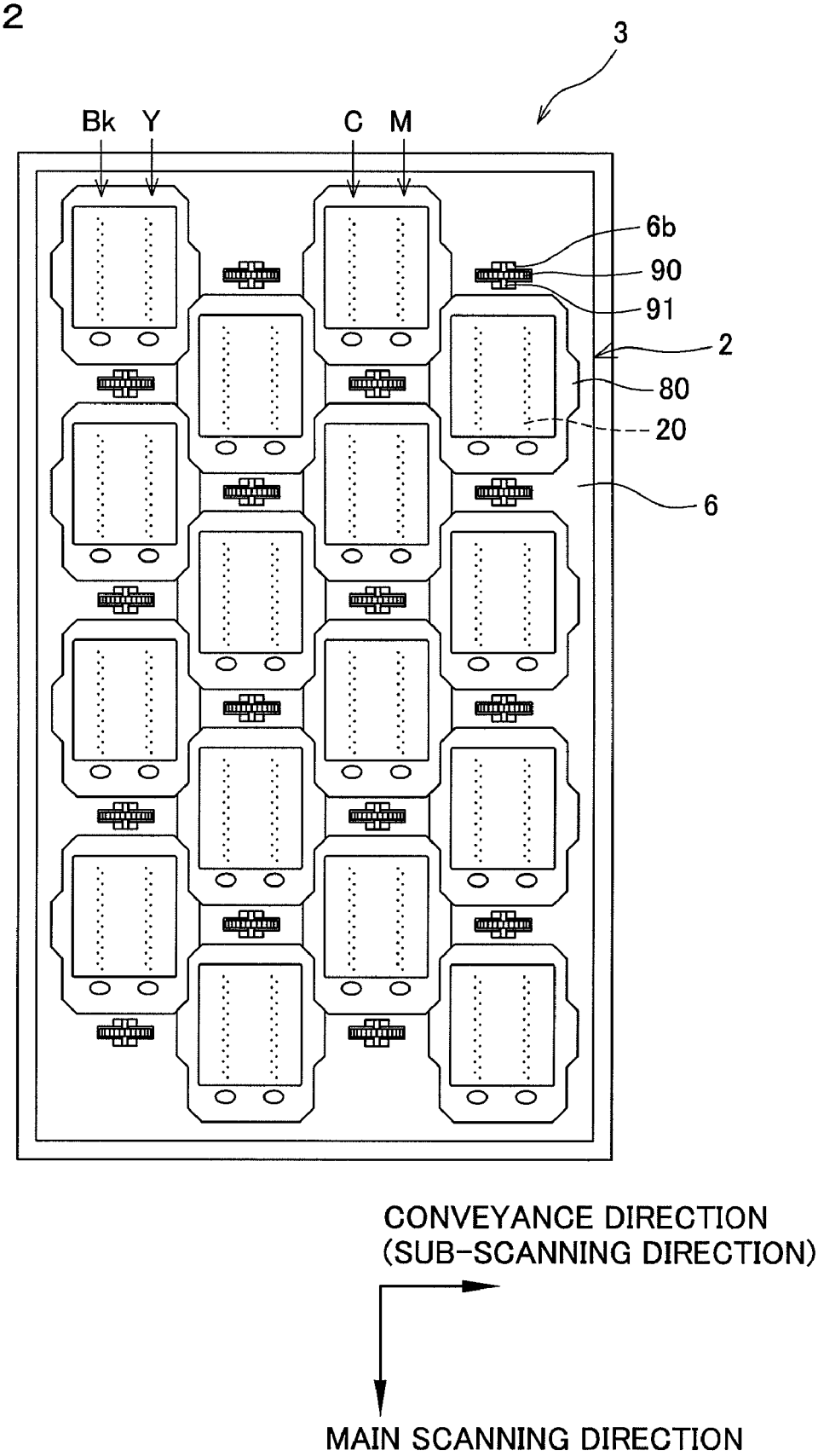
FIG. 2 is a plan view from above looking down the inkjet head from which a spur sustainer has been removed.

Now, the inkjet head 3 will be discussed with reference to FIG. 2 and FIG. 3. In FIG. 2, the pressure chamber 14 and through holes 15, 16, and 19 of FIG. 4 are not illustrated for the sake of simplicity.

Figure 3:
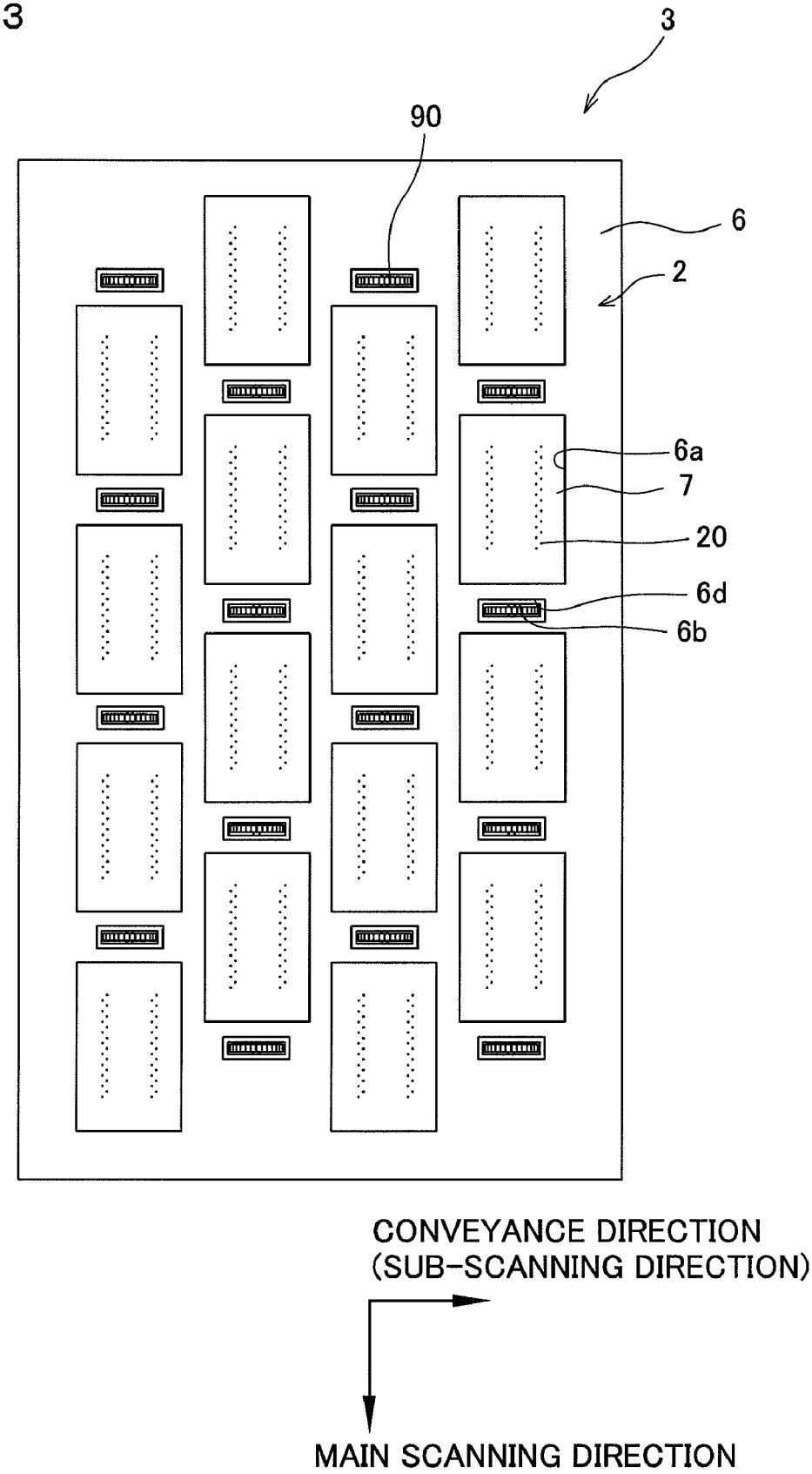
FIG. 3 is a plan view from below of the inkjet head.
Figure 4:
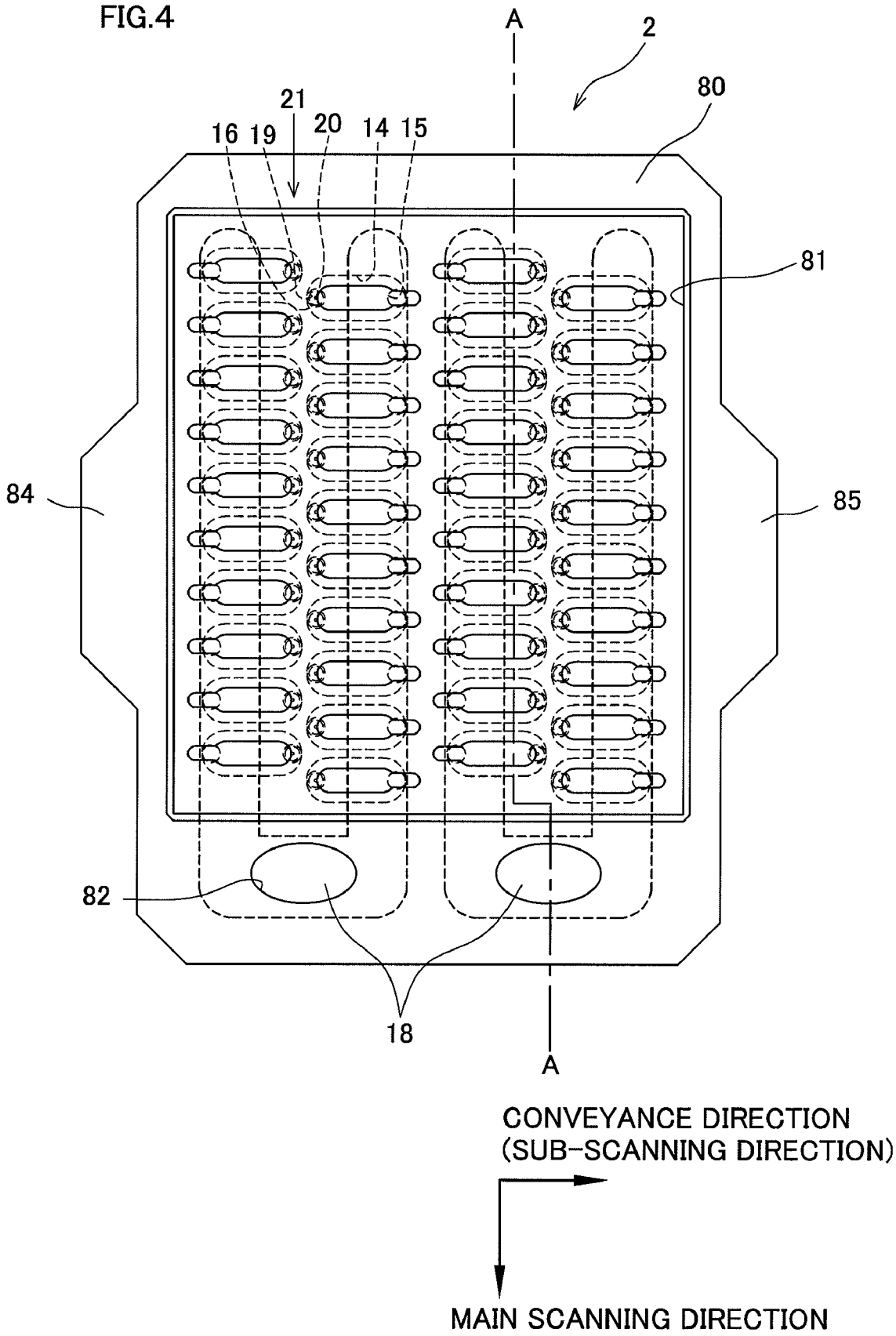
FIG. 4 is a plan view of a head unit.
Figure 5:
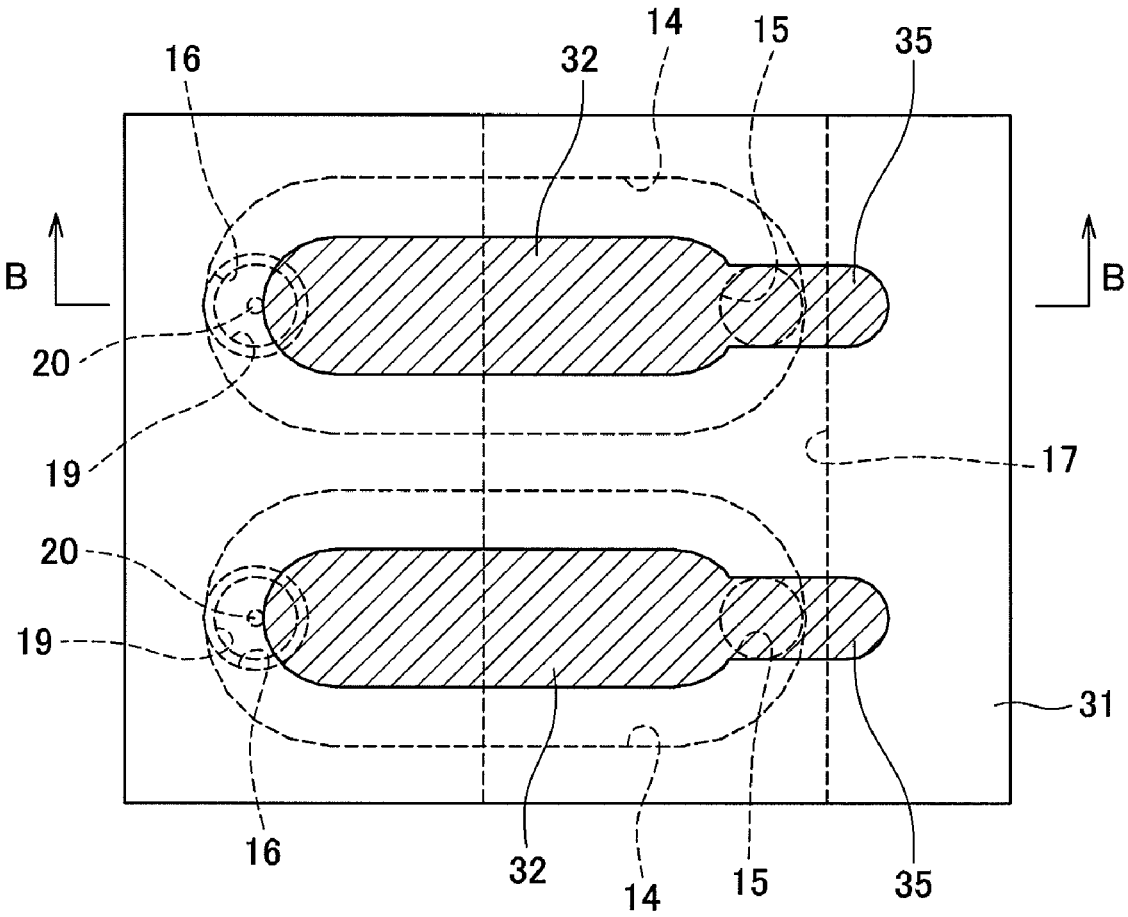
FIG. 5 is a partial enlarged view of FIG. 4.

As shown in FIG. 2 and FIG. 3, the inkjet head 3 includes: plural head unit 2 which form four rows in a staggered manner along the main scanning direction; a housing 6 (head supporting member) supporting the plural head units 2; and a spur sustainer 92 which sustains later-described spurs 90 (see FIG. 8).

First, the head units 2 will be discussed with reference to FIG. 4 to FIG. 7. As shown in FIG. 4 to FIG. 7, each of the head units 2 includes: a passage unit 4 (passage structure) in which an ink flow passage 22 including nozzles 20 and pressure chambers 14 is formed; a piezoelectric actuator 8 which applies pressure (ejection energy) to the ink in the pressure chambers 14 so as to eject the ink from the nozzles 20 of the passage unit 4; and a reinforcing plate 80 which reinforces the passage unit 4.

The passage unit 4 includes a cavity plate 10, a base plate 11, and a manifold plate 12 which are made of a metal material such as stainless steel, and a nozzle plate 13 which is made of a polymeric synthetic resin material such as polyimide. These four plates 10 to 13 are stacked and joined with one another. The nozzle plate 13 may be alternatively made of a metal material in the same manner as the plates 10 to 12.

The nozzle plate 13 has plural penetrating nozzles 20. These plural nozzles 20 are aligned in the main scanning direction (in the direction from the top to the bottom in FIG. 4) so as to form nozzle rows 21, and each four nozzle rows 21 are aligned in the sub-scanning direction. The nozzles 20 belonging to the four nozzle rows 21 eject ink in such a way that ink of the same color is ejected from two nozzle rows which are adjacent to each other in the sub-scanning direction. The lower surface of the nozzle plate 13 having these nozzles 20 functions as an ink ejection surface (droplet ejection surface) 7.

The cavity plate 10 is provided with plural pressure chambers 14 corresponding to the plural nozzles 20. Each pressure chamber 14 has a substantially elliptical shape wide in the conveyance direction, and one end of the pressure chamber 14 is arranged to overlap the nozzle 20 in a plan view. The base plate 11 has through holes 15 and 16 which overlap, in a plan view, the respective longitudinal ends of the pressure chamber 14.

The manifold plate 12 has four manifold passages 17 corresponding to the respective four nozzle rows 21. Each manifold passage 17 extends in the main scanning direction at the location where the passage 17 neighbors the corresponding nozzle row 21 in the conveyance direction, and overlaps a substantially half of the corresponding pressure chamber 14 in a plan view. Furthermore, as shown in FIG. 4, one end of each of the four manifold passages 17 (i.e. the lower end in FIG. 4) is connected to one of two ink supply openings 18 penetrating the cavity plate 10 which is the topmost layer, and two neighboring manifold passages 17 are connected to the same supply opening 18. The manifold plate 12 is provided with through holes 19 which overlap both the through holes 16 of the base plate 11 and the nozzles 20 of the nozzle plate 13 in plan view.

Figure 6:
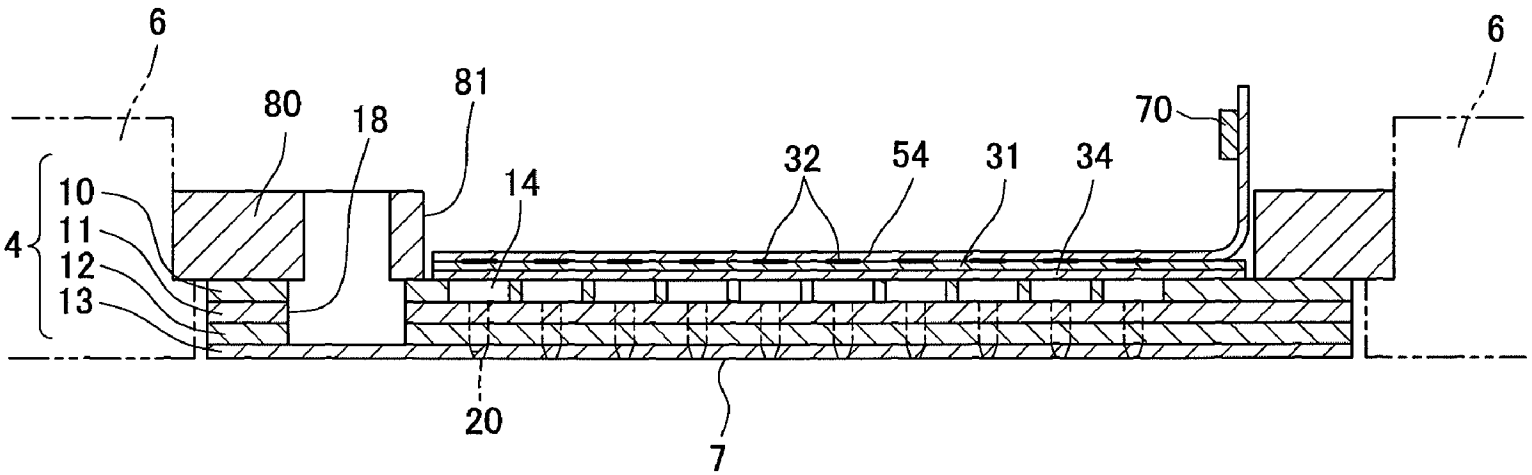
FIG. 6 is a cross section taken at A-A line in FIG. 4.
Figure 7:
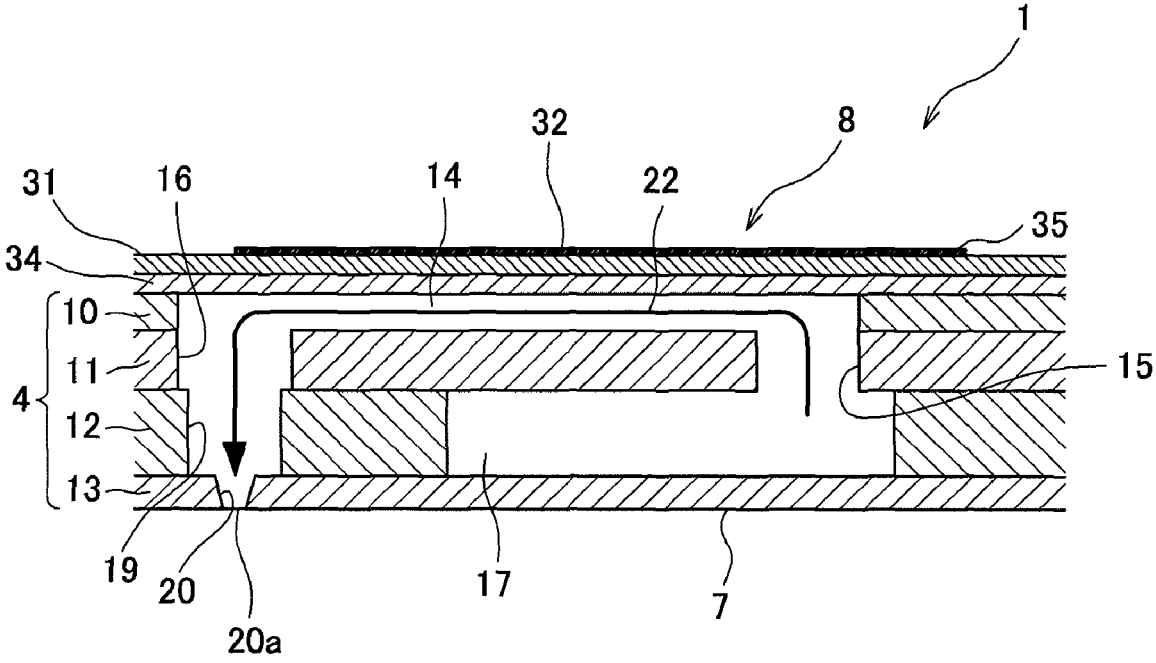
FIG. 7 is a cross section taken at B-B line in FIG. 5.

As shown in FIG. 6 and FIG. 7, the passage unit 4 is arranged so that the manifold passages 17 connected to the ink supply openings 18 are connected to the pressure chambers 14 via the through holes 15, and the pressure chambers 14 are further connected to the nozzles 20 via the through holes 16 and 19. In other words, the passage unit 4 has plural ink flow passages 22 stretching from the ink supply openings 18 to the nozzles 20 via the manifold passages 17 and the pressure chambers 14.

The piezoelectric actuator 8 has a diaphragm 34, a piezoelectric layer 31, and plural individual electrodes 32. The diaphragm 34 is made of a conductive material such as a metal material, and is connected to the upper surface of the cavity plate 10 so as to cover the plural pressure chambers 14. The conductive diaphragm 34 functions, as described later, as a common electrode which applies an electric field to a portion of the piezoelectric layer 31 which portion is sandwiched between the diaphragm 34 and the individual electrodes 32. The diaphragm 34 is connected to a ground wire at an unillustrated position, so that it is always kept at a ground potential.

The piezoelectric layer 31 is a mixed crystal of lead titanate and lead zirconate, and is made of a piezoelectric material mainly made of lead zirconate titanate (PZT) having ferroelectricity. This piezoelectric layer 31 is provided on the upper surface of the diaphragm 34 so as to stretch across the plural pressure chambers 14. The piezoelectric layer 31 is polarized in the thickness direction in advance.

The plural individual electrodes 32 are provided on the upper surface of the piezoelectric layer 31 so as to correspond to the respective pressure chambers 14. Each individual electrode 32 has a substantially elliptical shape in plan view and is smaller than the pressure chamber 14, and overlaps a substantially central portion of the pressure chamber 14 in plan view. One longitudinal end of the individual electrode 32 (i.e. the right end in FIG. 5) extends rightward but does not overlap the pressure chamber 14 in plan view, and the tip of this end functions as a contact 35. This contact 35 is connected to one terminal of a flexible printed circuit (FPC) 54 (see FIG. 6).

The FPC 54 is formed in such a way that wires made of a conductive material such as copper are printed on an insulator made of a resin material such as polyimide and a flexible base. This FPC 54 has a fixed part which is fixed to the upper surface of the piezoelectric actuator 8. The FPC 54 further has a non-fixed part which extends in the main scanning direction from the end of the passage unit 4 which end is opposite to the end where the ink supply opening 18 is formed, and is curved and extend upward along the inner wall surface of an opening 81 of a later-described reinforcing plate 80. In the space above the FPC 54 provided is a driver IC 70. This driver IC 70 selectively supplies either a predetermined drive potential or a ground potential to the individual electrode 32 via a wire formed on the FPC 54.

The function of the above-described piezoelectric actuator 8 will be discussed. When no pressure is applied to the ink (i.e. when the ink is not ejected from the nozzles 20), the electric potential of each individual electrode 32 is kept at the ground potential in advance. To one of the individual electrodes 32 in this state, a predetermined drive potential is supplied from the driver IC 70 via plural wires of the FPC 54. In response to this, a potential difference occurs between the individual electrode 32 to which the drive potential has been supplied and the diaphragm 34 which functions as a common electrode and is kept at the ground potential, with the result that an electric field in parallel to the thickness direction is generated at the piezoelectric layer 31 sandwiched between the aforesaid electrode 32 and the diaphragm 34. Since the direction of this electric field is identical with the polarization direction of the piezoelectric layer 31, the piezoelectric layer 31 polarized in the thickness direction contracts in the horizontal direction orthogonal to the direction of the electric field (transversal piezoelectric effect). Therefore a part of the piezoelectric layer 31, which part opposes the pressure chamber 14, deforms to bulge toward the pressure chamber 14 (unimorph deformation). Because this reduces the capacity of the pressure chamber 14, the pressure applied to the ink in the chamber increases and hence the ink is ejected from the nozzles 20 connected to the pressure chambers 14.

Now the reinforcing plate 80 will be discussed. As shown in FIG. 4, the reinforcing plate 80 is made of a metal material such as stainless steel, and is sufficiently thicker than the passage unit 4 and has high rigidity. Also, the reinforcing plate 80 has a substantially rectangular shape larger than the outer shape of the passage unit 4 in plan view, and has the rectangular opening 81 which is larger than the outer shape of the piezoelectric actuator 8 and accommodates the actuator 8 therein. Furthermore, at one end of the reinforcing plate 80 (lower end in FIG. 4), two openings 82 are formed to overlap the two ink supply openings 18 of the passage unit 4 in plan view.

The reinforcing plate 80 is joined with the upper surface of the cavity plate 10 while being in parallel to the ink ejection surface 7 and arranged so that the piezoelectric actuator 8 is accommodated in the opening 81. This reinforcing plate 80 functions to reinforce the passage unit 4 in such a way as to prevent the direction of ink ejection from the nozzles 20 from deviating due to reasons such as the warp of the passage unit 4.

The four corners of the reinforcing plate 80 are chamfered at a predetermined angle (45 degrees in the present embodiment) with respect to the main scanning direction. From the both edges of the reinforcing plate 80 in the width direction, which edges overlap the passage unit 4 in the sub-scanning direction of the reinforcing plate 80 (i.e. the horizontal direction in FIG. 4: sub-scanning direction), trapezoidal ear portions 84 and 85 protrude outwards, respectively. The angles of the slopes of the ear portions 84 and 85 with respect to the main scanning direction are identical with the angles of the champers of the four corners of the reinforcing plate 80. Thanks to these ear portions 84 and 85, the reinforcing plate 80 is easy to carry at the time of manufacture.

The passage unit 4 and the piezoelectric actuator 8 are attached to the above-described reinforcing plate 80, so that the head unit 2 is constructed.

Now the housing 6 will be described. As shown in FIG. 2 and FIG. 3, the housing 6 is rectangular in plan view and is supported by a chassis 25 of the printer (see FIG. 1) so as to be movable by a head elevating mechanism 131 (see FIG. 10) in the vertical direction (i.e. in the direction orthogonal to the ink ejection surfaces 7; ejection surface orthogonal direction). This housing 6 is provided with plural openings 6*a* which form four rows in a staggered manner in the main scanning direction so as to correspond to the positions of the plural ink ejection surfaces 7 and plural openings 6*b*. The openings 6*a* and the openings 6*b* are alternately formed.

Each of the openings 6*a* accommodates the passage unit 4 of the head unit 2 in such a way that the ink supply openings 18 of the head unit 2 are provided on the lower side in FIG. 2 and the nozzle row direction is in parallel to the main scanning direction. This passage unit 4 is accommodated such that the ink ejection surface 7 opposes in a parallel manner a record sheet P which is fed by the conveyor roller 5. As the lower surface of the reinforcing plate 80 is joined with the upper surface of the housing 6, the plural head units 2 are fixed to the housing 6. As such, in the housing 6, two head units 2 neighboring each other in the conveyance direction are provided to deviate from each other in the main scanning direction. The lower surface of the housing 6 and the ink ejection surface 7 are on the same plane.

The plural openings 6*a* are formed in the housing 6 in such a way that, when the plural passage units 4 of the head units 2 are respectively accommodated, the gap between two nozzles 20 neighboring in the main scanning direction in a single head unit 2 is identical with the gap between two nozzles 20 which are the closest to each other in the main scanning direction and belong to neighboring two head units 2, respectively. In other words, the head units 2 forming two rows in a staggered manner in the main scanning direction are arranged so that the nozzles 20 neighboring one another in the main scanning direction are equally distanced from one another, and hence a virtual single nozzle row which is longer than the nozzle row of each head unit 2 is formed.

The plural passage units 4 in the housing 6 are grouped into four rows of passage units as shown in FIG. 2, namely the leftmost row of passage units, the second leftmost row of passage units, the second rightmost row of passage units, and the rightmost row of passage units. Each row of passage units extends in the main scanning direction and includes four passage units each having four rows of nozzles. In the leftmost row of passage units, the left two rows of nozzles eject black ink and the right two rows of nozzles eject yellow ink. In the second leftmost row of passage units which forms a staggered arrangement with the leftmost rows of passage units, the left two rows of nozzles eject black ink and the right two rows of nozzles eject yellow ink. In the rightmost row of passage units, the left two rows of nozzles eject cyan ink and the right two rows of nozzles eject magenta ink. In the second rightmost row of passage units which forms a staggered arrangement with the rightmost rows of passage units, the left two rows of nozzles eject cyan ink and the two right rows of nozzles eject magenta ink. In this manner, the inkjet head 3 ejects four colors of ink in such a way that two rows of passage units neighboring each other in the sub-scanning direction eject ink with the same colors.

The reinforcing plates 80 of the two head units 2 neighboring each other in the sub-scanning direction are in contact with each other at the end faces of the edges in the sub-scanning direction where the ear portions 84 and 85 are not formed. These head units 2 in contact with each other are arranged so that the slope of the ear portion 84 of the reinforcing plate 80 of one head unit 2 is in contact with the chamfered edge of the reinforcing plate 80 of the other head unit 2.

After the reinforcing plates 80 are positionally adjusted in the main scanning direction, an adhesive made of photocurable (ultraviolet curable) resin is injected into the gap between the neighboring two reinforcing plates 80, so that these neighboring reinforcing plates 80 are fixed to each other. In this regard, the reinforcing plates 80 of the two head units 2 neighboring each other are joined by the adhesive at the bended edges formed by the existence of the ear portions 84 and 85. The joining force in this case is strong as compared to a case where the plates not having ear portions are joined at straight edges. In this way, the ear portions 84 and 85 are formed to overlap each other in the main scanning direction, only at the portion where the ink ejection surface 7 of the passage unit 4 is provided and high rigidity is required. This makes it possible to certainly reinforce the passage unit 4, while the head units 2 are densely disposed in the sub-scanning direction. Furthermore, since these ear portions 84 and 85 bulge toward the dead spaces formed by the staggered head units 2, they do not obstruct the downsizing of the printer. In addition, the downsizing of the printer is further ensured because the ink supply openings 18 are provided in the dead spaces formed by the staggered head units 2.

Now the following will describe a spur sustainer 92 in which spurs 90 are provided to be able to protrude from the openings 6*b* of the housing 6.

Figure 8:
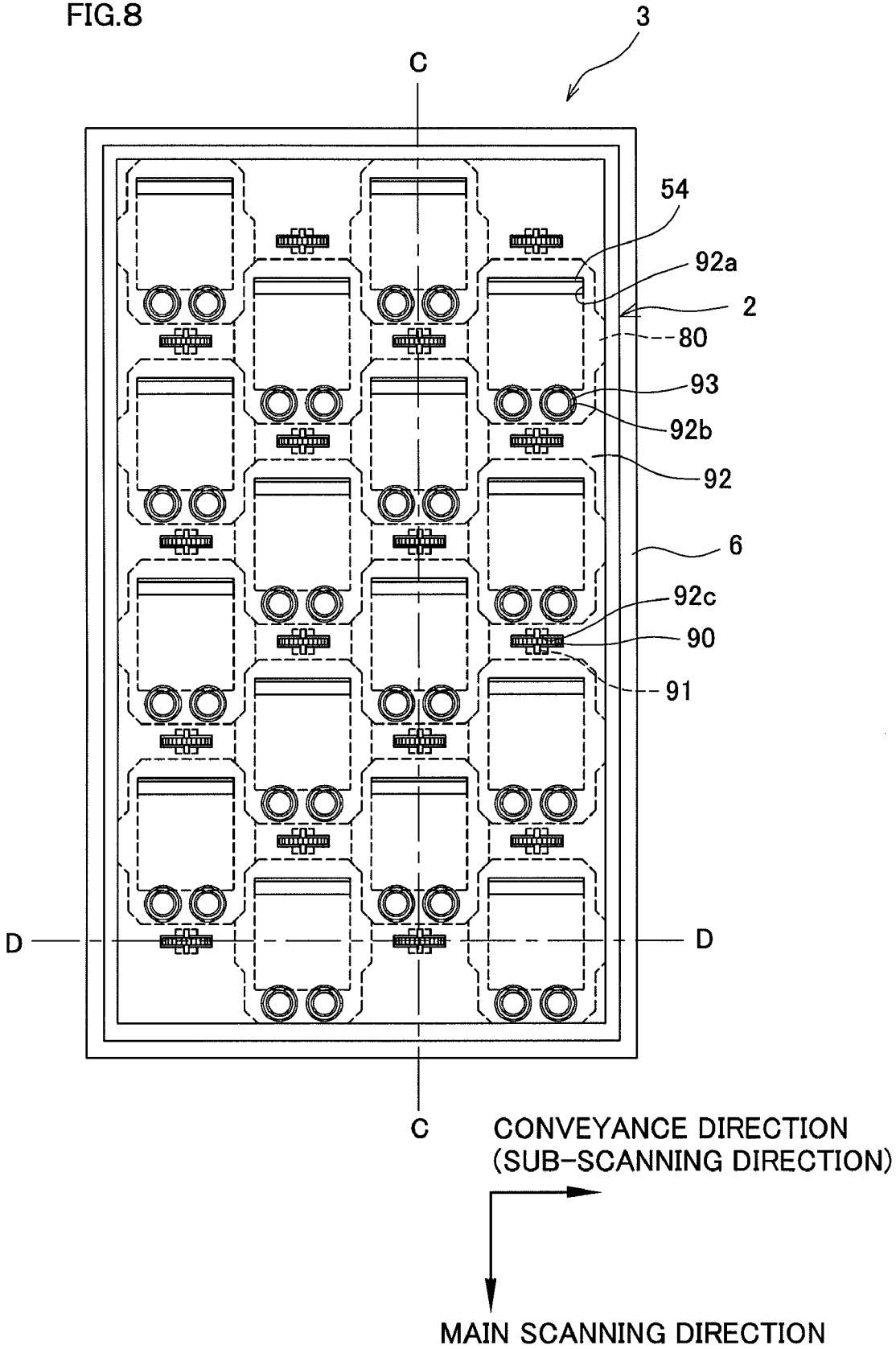
FIG. 8 is a plan view from above looking down the inkjet head provided with a spur sustainer.
Figure 9:
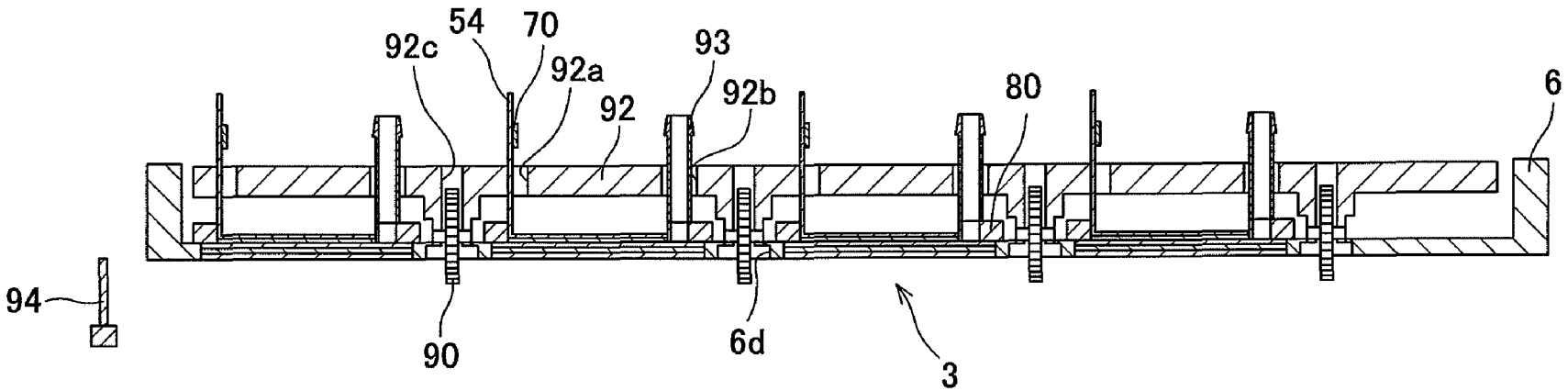
FIG. 9 is a cross section taken at C-C line in FIG. 8.
Figure 10:
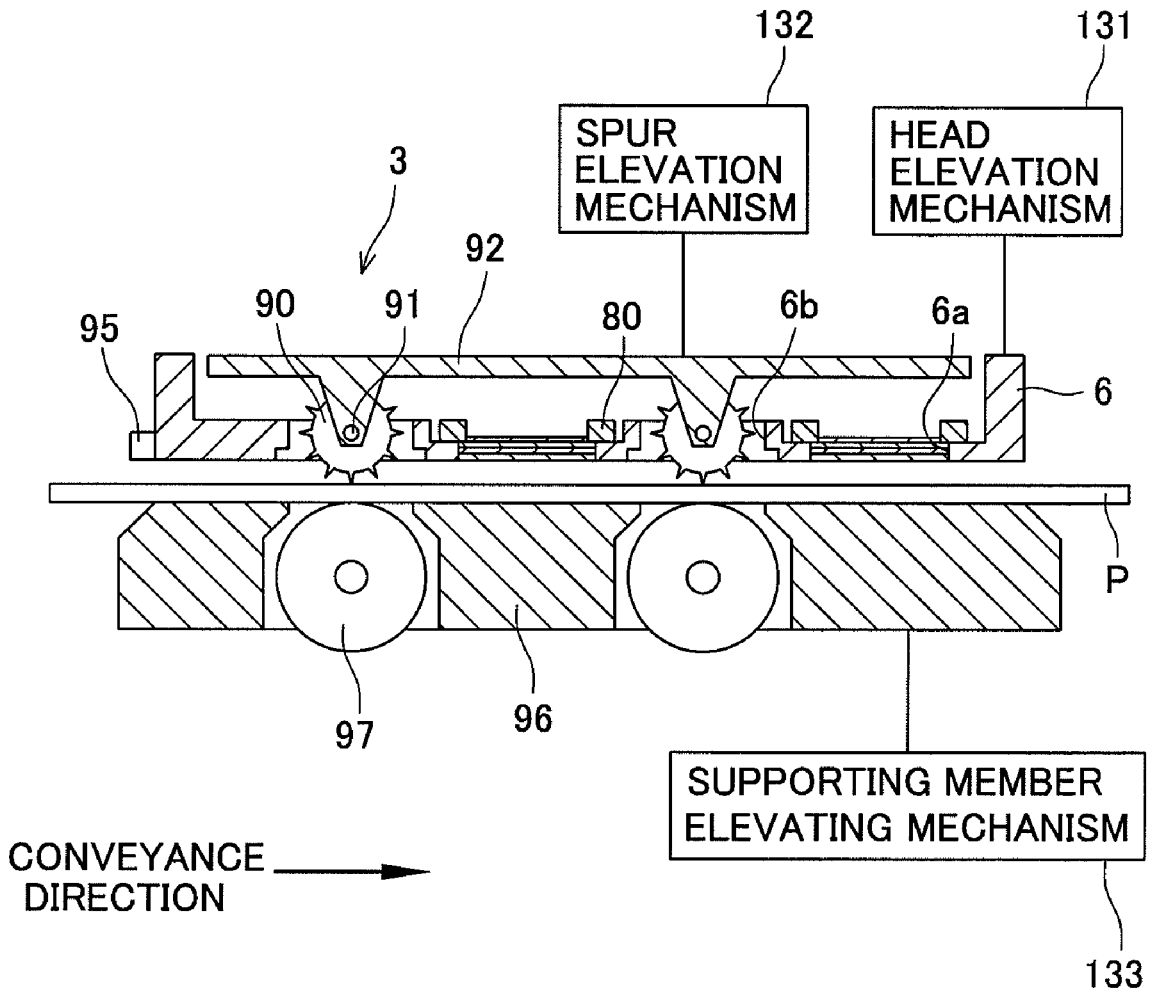
FIG. 10 is a cross section taken at D-D line in FIG. 8.

As shown in FIG. 8 to FIG. 10, the spur sustainer 92 is rectangular in shape and smaller than the outer shape of the housing 6, and is supported by the housing 6 in such a way as to be movable in the vertical direction by a spur elevating mechanism 132. The spur sustainer 92 covers plural head units 2 and has plural holes 92*a*, plural holes 92*b*, and plural holes 92*c*. In plan view, the holes 92*a* overlap the upper areas of the respective FPCs 54, the holes 92*b* overlap the respective ink supply openings 18, and the holes 92*c* overlaps the respective openings 6*b*. Since the spur sustainer 92 covers the plural head units 2, the head units 2 having the piezoelectric actuators 8 are protected.

The holes 92*a* of the spur sustainer 92 form four rows in a staggered manner in the main scanning direction, and correspond to the respective upper areas of the FPCs 54. This allows each FPC 54 to have a non-fixed part extending in the main scanning direction from the end which is opposite to the end where the ink supply openings 18 of the passage unit 4 are formed and to penetrate the hole 92*a* and to further extending upward.

The holes 92*b* of the spur sustainer 92 form four rows in a staggered manner in the main scanning direction, and correspond to the plural ink supply openings 18, respectively. To each hole 92*b*, a tube-shaped ink introducing component 93 whose one end is connected to the ink supply opening 18 is inserted. The other end of the ink introducing component 93 is connected to a tube connected to an unillustrated ink tank. From the ink tank, ink is supplied to the ink supply opening 18 via the ink introducing component 93.

The holes 92*c* of the spur sustainer 92 form four rows in a staggered manner in the main scanning direction, and correspond to the openings 6*b*, respectively. Each hole 92*c* is provided with a spur 90 (pushing component) and a rotation shaft 91. The both ends of the rotation shaft 91 are supported by the end face of the hole 92*c* so that the shaft direction is in parallel to the main scanning direction. The spur 90 is housed in and protrudes from the opening 6*b* (ink ejection surface 7) as the spur sustainer 92 vertically moves with respect to the housing 6.

In addition to the above, as shown in FIG. 10, between two conveyor rollers 5 in the conveyance direction, a drive roller 97 is provided to oppose the spur 90. This drive roller 97 is supported by the supporting member 96 which is vertically movable by a supporting member elevating mechanism 133, and the drive roller 97 is driven by a conveyor motor 121 (see FIG. 11). To put it differently, the spur 90 and the drive roller 97 form a roller pair, and a record sheet P fed by the conveyor mechanism 9 is sandwiched between the spur 90 and the drive roller 97.

The spur 90 rotates while being in contact with a record sheet P fed by the conveyor mechanism 9, so as to push the record sheet P in the direction of ink ejection from the nozzles 20. In this way, the spur 90 is provided between the head units 2 disposed in the conveyance direction, so as to be close to the head units 2. This prevents a record sheet P fed by the conveyor mechanism 9 from being warped, because the record sheet P is constrained by the spurs 90. It is noted that the spurs 90 are provided in positions not overlapping the head units 2 in plan view, i.e. provided in the dead spaces between the head units 2. Therefore the downsizing of the inkjet head 3 is possible even if the spurs 90 are provided.

Beside the supporting member 96 in the main scanning direction, a wiper 94 is provided which is as wide as the housing 6 in the sub-scanning direction. The wiper 94 is withdrawn to be away from the inkjet head 3 in a normal condition. When the wiping is carried out, the wiper 94 is moved in the main scanning direction by the wiper drive motor 125, in the space between the inkjet head 3 and the supporting member 96 which space is formed as a result of the downward movement of the supporting member 96. While this movement in the main scanning direction is carried out, the tip of the wiper 94 is in contact with the ink ejection surface 7 and hence ink adhered to the ink ejection surfaces 7 of the head units 2 is wiped out.

In addition to the above, the housing 6 has a concave portion 6*d* at the lower surface. This concave portion 6*d* surrounds the protruding spur 90 and is larger than the opening 6*b*. The concave portion 6*d* functions in such a way that, the ink which is ejected from the nozzles 20 but does not impact on the record sheet P and remains on the ink ejection surface 7 is accumulated in the concave portion 6*d* before reaching the spur 90, with the result that the intrusion of the ink to the spur 90 is prevented. Furthermore, a sheet detection sensor 95 is disposed at the upstream end of the housing 6 in the conveyance direction (i.e. the left end in FIG. 10).

Figure 11:
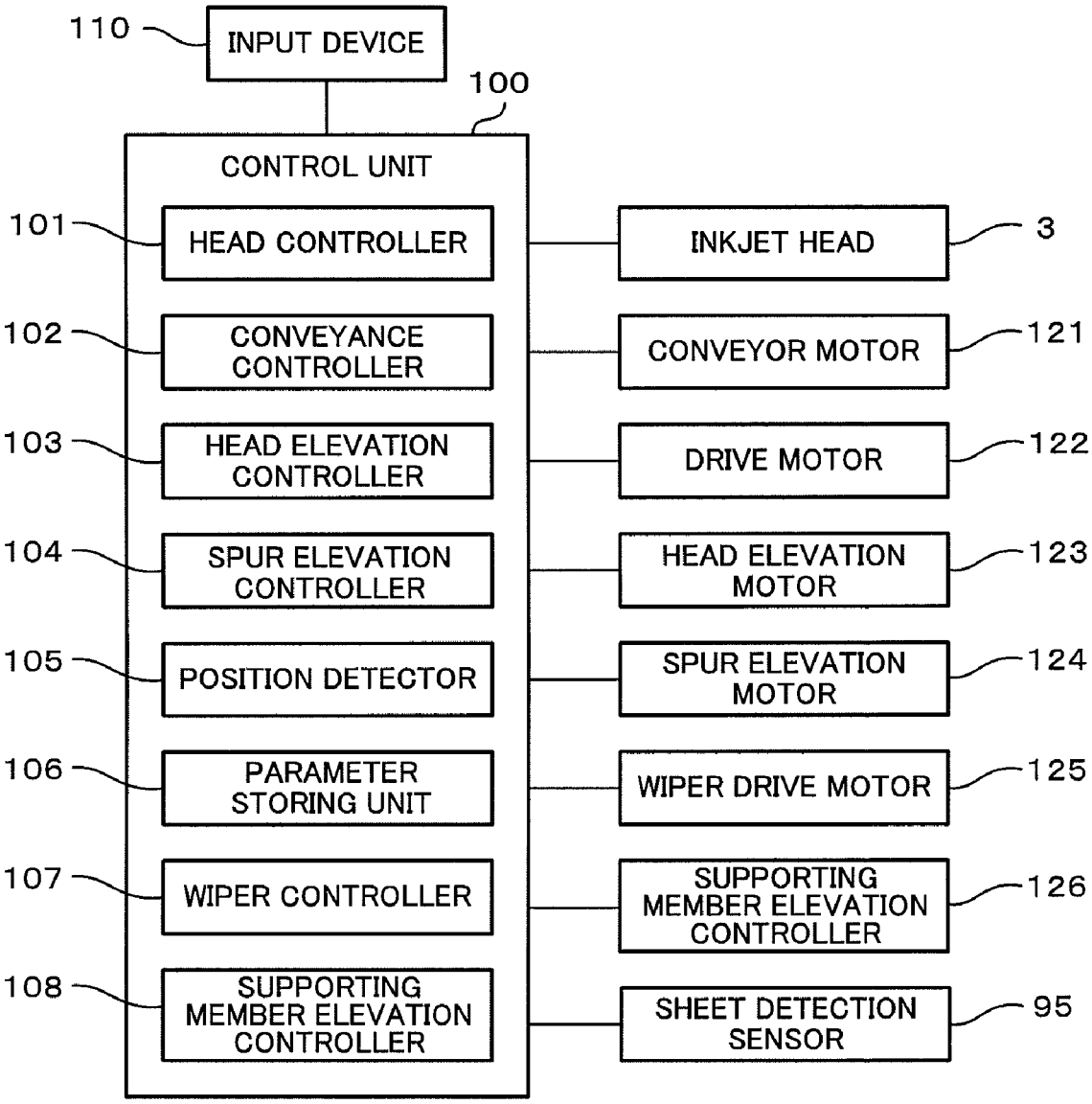
FIG. 11 is a block diagram schematically showing the electrical construction of the inkjet printer.

Now, the electrical construction of the inkjet printer 1 centered around the control unit 100 will be discussed with reference to FIG. 11. As shown in FIG. 11, the control unit 100 may perform various types of below-discussed control by software. For example, the control unit 100 may be provided with components such as a CPU which is a central processing unit, a ROM (Read Only Memory) which stores various kinds of programs and data for controlling the overall operation of the inkjet printer 1, and a RAM (Random Access Memory) which temporarily stores data processed by the CPU, and a program stored in the ROM may be executed by the CPU. Alternatively, the control unit 100 may be realized by hardware which is a combination of various circuits including an arithmetic circuit.

This control unit 100 includes a head controller 101, a conveyance controller 102, a head elevation controller 103, a spur elevation controller 104, a position detector 105, a parameter storing unit 106, a wiper controller 107, and a supporting member elevation controller 108.

The head controller 101 causes the inkjet head 3 to eject ink onto a record sheet P based on print data supplied from an input device 110 such as a PC so that a desired image or the like is printed on the record sheet P.

The conveyance controller 102 performs the conveyance of a record sheet P by controlling a conveyor motor 121 which drives the two conveyor rollers 5 of the conveyor mechanism 9 and a drive motor 122 which drives the drive roller 97 opposing the spur 90.

The head elevation controller 103 changes the gap between the ink ejection surface 7 and the surface of a record sheet P in such a way as to move up or down the inkjet head 3 with respect to the chassis 25 of the inkjet printer 1 by controlling a head elevation motor 123 which moves up and down the head elevating mechanism 131 based on the thickness of the record sheet P and a print mode (droplet ejection mode) which is input from the input device 110 along with print data. A print mode is input to the printer from a later-described input device 110 (see FIG. 10) in response to the user's selection. Examples of the print mode are plural modes such as a high-definition mode and a low-definition mode, which correspond to print qualities desired by the user. As the desired print quality increases, the gap between the ink ejection surface 7 and the record sheet P is narrowed to improve the impact accuracy.

The spur elevation controller 104 changes the position of the spur 90 between the protruding position where the spur 90 protrudes from the opening 6*b* of the housing 6 and the retracted position where the spur 90 does not protrude from the opening 6*b*, by controlling a spur elevation motor 124 which moves up and down the spur elevating mechanism 132 so as to move up or down, with respect to the inkjet head 3, the spur sustainer 92 in which the spurs 90 are provided. In addition to this, when the spur 90 is in the protruding position, the spur elevation controller 104 controls the spur elevation motor 124 to change the degree of protrusion of the spur 90 from the opening 6*b*, based on information which is input from the input device 110 and relates to the thickness of the record sheet P.

The position detector 105 detects the position of a record sheet P conveyed by the conveyor mechanism 9, based on the timing to feed the record sheet P detected by the sheet detection sensor 95 and the information regarding the revolution number of the conveyor roller 5.

The parameter storing unit 106 stores information of (i) a gap between the ink ejection surface 7 and the record sheet P in each print mode and each thickness of the record sheet P and (ii) a degree of protrusion of the spur 90 from the opening 6*b* in each thickness of the record sheet P. The wiper controller 107 controls the wiper drive motor 125 so as to move the wiper 94 along the main scanning direction. The supporting member elevation controller 108 controls a supporting member elevation motor 126 which moves up and down the supporting member 96 so as to move up or down the supporting member 96.

As the spurs 90 are vertically movable, the inkjet printer 1 can adjust the aforesaid gap and the degree of protrusion of the spurs 90 in accordance with the type (thickness) of the record sheet P or the print mode, and can retract the spurs 90 at the time of maintenance. First, the printing operations onto a record sheet P in accordance with its thickness and the print mode will be described. In the present embodiment, the printing operations onto sheets such as a regular sheet, a glossy sheet, and a thick sheet such as an envelope will be described as examples of record sheets P having different thickness.

The printing operation onto a regular sheet (which is 1.5 mm thick for example) will be described. As a regular sheet is fed to the conveyor mechanism 9, the print mode, the information of the thickness of the record sheet P (regular sheet in this case), the print data, and the like are input from the input device 110 to the control unit 100. The inkjet printer 1 then controls the head elevation controller 103 so as to move up or down the inkjet head 3 in such a way that the gap between the ink ejection surface 7 of the inkjet head 3 and the surface of the regular sheet is adjusted to a desired gap in accordance with the thickness of the regular sheet stored in the parameter storing unit 106.

In doing so, the higher the definition required by the print mode is, the more the inkjet head 3 is lowered, with the result that the gap between the ink ejection surface 7 of the inkjet head 3 and the surface of the regular sheet is decreased. In the case of regular sheets, however, the gap is longer than those of the other types of sheets because regular sheets are easily warped in response to the permeation of ink, and hence the gap is arranged so that the regular sheet does not contact the ink ejection surface 7 of the inkjet head 3 even if it is warped due to the permeation of ink.

As the inkjet head 3 is moved up or down, the gap between the spurs 90 and the surface of the record sheet P is also changed because the spurs 90 are supported by the inkjet head 3 via the spur sustainer 92. In this regard, the inkjet printer 1 controls the spur elevation controller 104 to move up or down the spur sustainer 92 so that the degree of protrusion of each spur 90 from the opening 6*b* of the housing 6, i.e. the pressure onto the record sheet P by the spurs 90 corresponds to the thickness of the regular sheet stored in the parameter storing unit 106. In this regard, irrespective of the print mode, the pressure onto the record sheet P by the spurs 90 must be identical if the thickness of the record sheet P is identical. The higher the printing quality required by the print mode is, the smaller the degree of protrusion of the spur 90 from the opening 6*b* of the housing 6 is, because the inkjet head 3 is close to the conveyor mechanism 9. As such, the degree of protrusion of the spur 90 is changed so that the spurs 90 push the record sheet P. The inkjet printer 1 then controls the head controller 101 to eject ink from the nozzles 20 of the inkjet head 3, so as to print an image or the like on the regular sheet.

Now, the printing operation onto a thick sheet such as an envelope will be described. An envelope is not warped so much in response to ink permeation, because it is thicker than the regular sheet. For this reason, the inkjet printer 1 controls the head elevation controller 103 to move up or down the inkjet head 3 so that the gap corresponds to the thickness of the envelope stored in the parameter storing unit 106 to be narrower than the gap in the case of regular sheet.

Thereafter, the inkjet printer 1 controls the spur elevation controller 104 to move up or down the spur sustainer 92 so that the degree of protrusion corresponds to the thickness of the envelope stored in the parameter storing unit 106. The inkjet printer 1 then controls the head controller 101 to eject ink from the nozzles 20 of the inkjet head 3 so that an image or the like is formed on the envelope.

The printing operation onto a glossy sheet (which is 0.8 mm thick for example) will now be described. A typical glossy sheet is hardly warped in response to ink permeation as compared to the regular sheet, and is often used for printing high-quality images such as photos. Taking account of this, the inkjet printer 1 controls the head elevation controller 103 to move up or down the inkjet head 3 so that the gap corresponds to the thickness of the glossy sheet stored in the parameter storing unit 106 to be narrower than those in the cases of the regular sheet and thick envelope.

Thereafter, the inkjet printer 1 controls the spur elevation controller 104 to move up or down the spur sustainer 92 so that the degree of protrusion corresponds to the thickness of the glossy sheet stored in the parameter storing unit 106. The inkjet printer 1 then controls the head controller 101 to eject ink from the nozzles 20 of the inkjet head 3, so that an image such as a photo or the like is formed on the glossy sheet.

Now, the operation of the inkjet printer 1 when the position detector 105 cannot properly detect a record sheet P will be described. When a record sheet P is not properly detected, e.g. when the position detector 105 continuously detects a record sheet P irrespective of the actual existence of the sheet or no sheet is detected even if the conveyance is actually being carried out, the inkjet printer 1 controls the spur elevation controller 104 to move the spur 90 to the retracted position. Since the gap between the head unit 2 and the conveyor mechanism 9 is narrow, this gap portion is susceptible to paper jam. When the record sheet P is not properly detected by the position detector 105, the record sheet P is likely to be stopping in the midst of the conveyance by the conveyor mechanism 9 due to reasons such as paper jam. In such a case, the spurs 90 are moved to the retracted position so that the constraint of the record sheep P by the spurs 90 and the drive rollers 97 is cancelled. This makes it easy to remove the record sheet P jammed around the head units 2.

Figure 12:
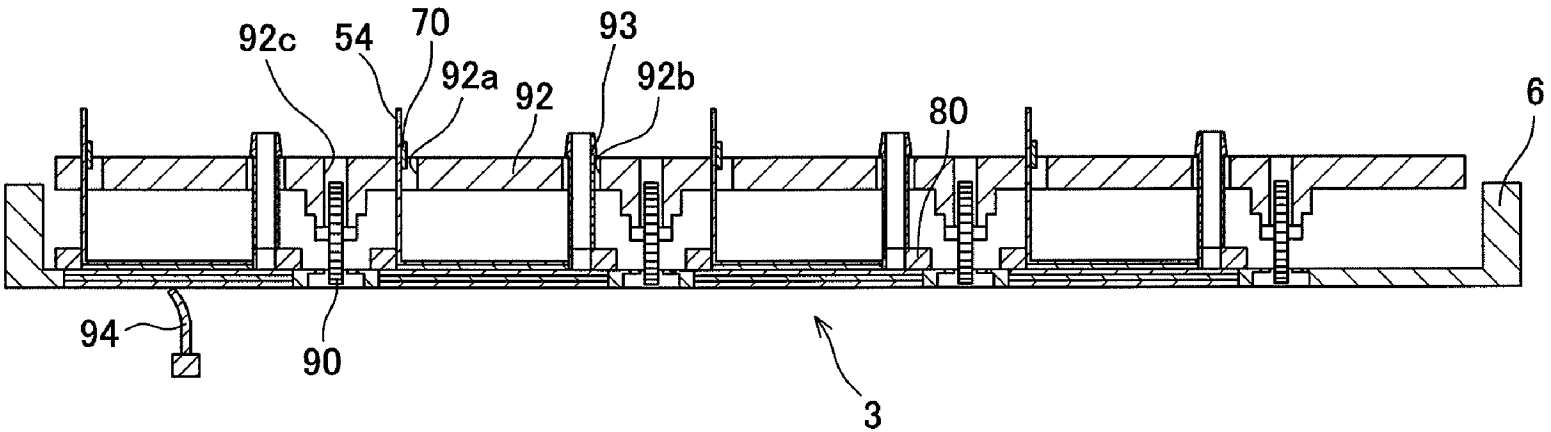
FIG. 12 is a cross section showing how a spur protrudes from an opening at the time of wiping.

Now the maintenance operation of the ink ejection surface 7 by the wiper will be described. As shown in FIG. 12, first the inkjet printer 1 controls the spur elevation controller 104 to move the spurs 90 to the retracted position and controls the supporting member elevation controller 108 to move the supporting member 96 downward. Thereafter, the inkjet printer 1 controls the wiper controller 107 to move the wiper 94 in the main scanning direction so that the tip of the wiper 94 is in contact with the ink ejection surface 7 in the space between the supporting member 96 and the inkjet head 3, with the result that the ink adhered to the ink ejection surfaces 7 of the plural head units 2 is wiped away. In this manner, the spurs 90 are moved to the retracted position immediately before the wiping operation by the wiper 94. This makes it possible to prevent the ink wiped away by the wiper 94 from adhering to the spurs 90.

In the inkjet printer 1 of the present embodiment, since the spurs 90 are provided in the vicinity of the head units 2, the record sheet P is constrained by the spurs 90 at the portions around the areas where the ink ejected from the head unit 2 impacts, with the result that the warp of the record sheet P is certainly prevented. Furthermore, since the spurs 90 are vertically movable and hence they can be housed in and protrude from the opening 6*b*, it is possible to freely change the positional relationship (degree of protrusion and state of protrusion) between the spurs 90 and the ink ejection surface 7 in accordance with the conditions, for example the spurs 90 are withdrawn not to protrude from the openings 6*b* when the maintenance of the head units 2 is carried out or when the spurs 90 are unnecessary. Moreover, the gap is suitably adjustable in accordance with the thickness of the record sheet P and the print mode.

The following will describe various variations of the above-described embodiment. In the present embodiment, plural head units 2 are provided in a staggered manner and plural spurs 90 are provided in the spaces formed by the staggered arrangement. Alternatively, only one head unit 2 is provided and any number of spurs which can be housed in and protrude from the ink ejection surface 7 are provided in the vicinity of the head unit 2.

In the present embodiment, the reinforcing plate 80 is chamfered so that the ear portions 84 and 85 are formed. Alternatively, the reinforcing plate 80 may have a rectangular shape.

In addition to the above, the spurs 90 and the head units 2 are alternately provided in the present embodiment. Alternatively, the spurs 90 may be provided in the vicinity of the head unit 2 in various ways.

In addition to the above, in the present embodiment the information regarding the thickness of the record sheet P is obtained from the input device 110. Alternatively, the information regarding the thickness of the record sheet P may be obtained from a laser displacement sensor or the like which is provided upstream of the inkjet head 3 in the conveyance direction.

In addition to the above, in the present embodiment the spur sustainer 92 having the spurs 90 is arranged to be able to move up and down with respect to the housing 6. Alternatively, the spur sustainer 92 may be arranged to be able to move up and down with respect to the chassis 25 of the printer in the same manner as the housing 6.

In addition to the above, in the present embodiment there are four nozzle rows in the main scanning direction. The number of nozzle rows, however, may be different from four.

In addition to the above, in the present embodiment the degree of protrusion and the state of protrusion are identical among the spurs 90. Alternatively, each spur 90 is individually movable and the degree of protrusion and the state of protrusion are different among the spurs 90.

In addition to the above, in the present embodiment, the wiper 94 is provided beside the supporting member 96 in the main scanning direction and moves in the main scanning direction so as to wipe away the ink adhered to the ink ejection surface 7. Alternatively, the wiper 94 is provided beside the supporting member 96 in the sub-scanning direction and moves in the sub-scanning direction so as to wipe away the ink adhered to the ink ejection surface 7. In other words, the wiper 94 is arbitrarily disposed as long as the wiper or the inkjet head 3 moves relative to each other in the direction in parallel to the ink ejection surface 7 and the ink ejection surface 7 is wiped by the wiper 94.

Furthermore, the spurs 90 may be moved to the retracted position so as not to push the record sheet P in some cases, because some types of record sheets P are hardly warped or are better not to be touched due to slow permeation of ink.

In addition to the above, in the present embodiment the type of the record sheet P and the print mode are individually input from the input device 110. Alternatively, the print mode is uniquely determined by the selection of the type of the record sheet P by the user.

The present embodiment is an example in which the present invention is used for an inkjet printer which forms an image or the like by ejecting ink onto a record sheet. The application of the present invention, however, is not limited to this. The present invention is applicable for various droplet ejectors which suitably eject various kinds of liquid other than ink onto an object.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A droplet ejector comprising:

at least one head unit having a droplet ejection surface on which plural nozzles are provided;

a conveyor mechanism which conveys, at a position opposing the ejection surface, an ejection target in a conveyance direction in parallel to the ejection surface, the ejection target being an object on which a droplet from the at least one head unit impacts;

at least one pushing component which is arranged to be movable with respect to the at least one head unit in a direction orthogonal to the ejection surface, the at least one pushing component pushing the ejection target in a direction of droplet ejection from the nozzles while protruding from the ejection surface;

a pushing drive mechanism which moves the at least one pushing component in the direction orthogonal to the ejection surface, between a protruding position in which the at least one pushing component protrudes from the ejection surface of the at least one head unit and a retracted position in which the at least one pushing component does not protrude from the ejection surface;

a control unit for controlling the at least one head unit, the conveyor mechanism, and the pushing drive mechanism; and a wiper which is arranged to be movable relative to the ejection surface in a direction in parallel to the ejection surface and which wipes away liquid adhered to the ejection surface, wherein, the at least one pushing component is provided in the vicinity of the at least one head unit, and before the wiper performs wiping, the control unit controls the pushing drive mechanism to move the at least one pushing component to the retracted position.

2. The droplet ejector according to claim 1, further comprising:

a detection sensor which detects the ejection target conveyed by the conveyor mechanism, wherein, when the detection sensor does not properly detect the ejection target during the ejection target is being conveyed by the conveyor mechanism, the control unit controls the pushing drive mechanism to move the at least one pushing component to the retracted position.

3. The droplet ejector according to claim 1, wherein, the control unit controls the pushing drive mechanism to change a degree of protrusion of the at least one pushing component from the ejection surface.

4. The droplet ejector according to claim 1, wherein, a plurality of the head units are disposed in the conveyance direction, and each pushing component is provided between two head units neighboring each other in the conveyance direction.

5. A droplet ejector comprising:

at least one head unit having a droplet ejection surface on which plural nozzles are provided;

a conveyor mechanism which conveys, at a position opposing the ejection surface, an ejection target in a conveyance direction in parallel to the ejection surface, the ejection target being an object on which a droplet from the at least one head unit impacts;

at least one pushing component which is arranged to be movable with respect to the at least one head unit in a direction orthogonal to the ejection surface, the at least one pushing component pushing the ejection target in a direction of droplet ejection from the nozzles while protruding from the ejection surface;

a pushing drive mechanism which moves the at least one pushing component in the direction orthogonal to the ejection surface, between a protruding position in which the at least one pushing component protrudes from the ejection surface of the at least one head unit and a retracted position in which the at least one pushing component does not protrude from the ejection surface;

a control unit for controlling the at least one head unit, the conveyor mechanism, and the pushing drive mechanism, the control unit controlling the pushing drive mechanism to change a degree of protrusion of the at least one pushing component from the ejection surface;

a head supporting member which supports the at least one head unit and is movable in the direction orthogonal to the ejection surface; and a head drive mechanism which moves the head supporting member in the direction orthogonal to the ejection surface, wherein, the at least one pushing component is attached to the head supporting member so as to be movable in the direction orthogonal to the ejection surface with respect to the head supporting member, and the control unit controls the head drive mechanism to adjust a gap between the ejection target and the ejection surface, and controls the pushing drive mechanism to change the degree of protrusion of the at least one pushing component in accordance with the adjusted gap.

6. The droplet ejector according to claim 5, wherein, the control unit changes the gap and the degree of protrusion of the at least one pushing component in accordance with the thickness of the ejection target conveyed by the conveyor mechanism.

7. The droplet ejector according to claim 5, wherein, the control unit is arranged to cause the at least one head unit to execute a mode selected from plural droplet ejection modes which require different impact accuracies of droplets on the ejection target, respectively, and the control unit changes the gap and the degree of protrusion in accordance with the selected droplet ejection mode.

8. A droplet ejector comprising:

at least one head unit having a droplet ejection surface on which plural nozzles are provided;

a conveyor mechanism which conveys, at a position opposing the ejection surface, an ejection target in a conveyance direction in parallel to the ejection surface, the ejection target being an object on which a droplet from the at least one head unit impacts;

at least one pushing component which is arranged to be movable with respect to the at least one head unit in a direction orthogonal to the ejection surface, the at least one pushing component pushing the ejection target in a direction of droplet ejection from the nozzles while protruding from the ejection surface;

a pushing drive mechanism which moves the at least one pushing component in the direction orthogonal to the ejection surface, between a protruding position in which the at least one pushing component protrudes from the ejection surface of the at least one head unit and a retracted position in which the at least one pushing component does not protrude from the ejection surface; and a control unit for controlling the at least one head unit, the conveyor mechanism, and the pushing drive mechanism, the control unit controlling the pushing drive mechanism to change a degree of protrusion of the at least one pushing component from the ejection surface, wherein, on each head unit, the nozzles are provided in a direction orthogonal to the conveyance direction, each two of the head units neighboring each other in the conveyance direction are deviated in a direction in parallel to a nozzle row, and each pushing component neighbors one of the each two head units in the direction in parallel to the nozzle row and neighbors the other of the each two head units in the conveyance direction.

9. A droplet ejector comprising:

at least one head unit having a droplet ejection surface on which plural nozzles are provided;

a conveyor mechanism which conveys, at a position opposing the ejection surface, an ejection target in a conveyance direction in parallel to the ejection surface, the ejection target being an object on which a droplet from the at least one head unit impacts;

at least one pushing component which is arranged to be movable with respect to the at least one head unit in a direction orthogonal to the ejection surface, the at least one pushing component pushing the ejection target in a direction of droplet ejection from the nozzles while protruding from the ejection surface;

a pushing drive mechanism which moves the at least one pushing component in the direction orthogonal to the ejection surface, between a protruding position in which the at least one pushing component protrudes from the ejection surface of the at least one head unit and a retracted position in which the at least one pushing component does not protrude from the ejection surface;

a control unit for controlling the at least one head unit, the conveyor mechanism, and the pushing drive mechanism, the control unit controlling the pushing drive mechanism to change a degree of protrusion of the at least one pushing component from the ejection surface; and a sustainer which sustains the at least one pushing component and is movable in the direction orthogonal to the ejection surface with respect to the at least one head unit, the sustainer being driven by the pushing drive mechanism, wherein, the at least one head unit includes a passage structure in which a liquid passage having the nozzles is formed and an actuator unit which is provided on a surface of the passage structure and which applies an ejection energy to liquid in the liquid passage, and the sustainer is arranged to cover the actuator unit of the at least one head unit.

10. The droplet ejector according to claim 9, wherein, the sustainer has a hole through which a wiring component connected to the actuator unit penetrates.

* * * * *